US007124551B1

(12) United States Patent
Patera

(10) Patent No.: US 7,124,551 B1
(45) Date of Patent: Oct. 24, 2006

(54) SIDING INSTALLATION TOOL

(76) Inventor: David Patera, 236 Elk Park Rd., Columbia Falls, MT (US) 59912

( * ) Notice: Subject to any disclaimer, the term of this patent is extended or adjusted under 35 U.S.C. 154(b) by 415 days.

(21) Appl. No.: 10/670,645

(22) Filed: Sep. 25, 2003

Related U.S. Application Data

(60) Provisional application No. 60/416,150, filed on Oct. 4, 2002.

(51) Int. Cl.
*E04D 15/00* (2006.01)
*E04F 21/00* (2006.01)
*E04G 21/14* (2006.01)

(52) U.S. Cl. ..... 52/749.1; 52/DIG. 1; 52/741.13; 52/747.1; 33/647

(58) Field of Classification Search ..... 52/DIG. 1, 52/741.13, 741.1, 749.1, 749.12, 748.1; 33/646, 33/647, 648, 649
See application file for complete search history.

(56) References Cited

U.S. PATENT DOCUMENTS 652,256 A * 6/1900 Farmer ..... 33/411
774,114 A * 11/1904 Spear ..... 33/411
1,115,202 A * 10/1914 Ingles ..... 33/646
1,192,651 A * 7/1916 Leonard ..... 33/648
2,575,595 A * 11/1951 Rienecker ..... 269/40
4,009,743 A * 3/1977 Ackerman ..... 81/45
4,021,979 A * 5/1977 Rez ..... 52/127.1
4,112,636 A * 9/1978 Hays ..... 52/98
4,425,714 A * 1/1984 Kelly, Jr. ..... 33/646
4,473,100 A * 9/1984 Wheeler ..... 81/45
4,485,543 A * 12/1984 Flores et al. ..... 29/281.1
5,224,309 A * 7/1993 Bodell ..... 52/127.1
5,299,403 A * 4/1994 Fentz ..... 52/404.2
D362,812 S * 10/1995 Meyer ..... D8/349
5,655,337 A * 8/1997 Bryant et al. ..... 52/127.2
5,692,311 A * 12/1997 Paquin ..... 33/647
5,702,218 A * 12/1997 Onofrio ..... 411/552
5,884,447 A * 3/1999 Earp ..... 52/489.1
6,684,521 B1 * 2/2004 Rempe ..... 33/647
6,836,969 B1 * 1/2005 Bates ..... 33/42
6,848,192 B1 * 2/2005 Partin ..... 33/647
6,904,729 B1 * 6/2005 Shroyer ..... 52/510
6,904,732 B1 * 6/2005 Richmond ..... 52/749.1
6,928,743 B1 * 8/2005 Marshall ..... 33/648

* cited by examiner

*Primary Examiner*—Carl D. Friedman
*Assistant Examiner*—Chi Q. Nguyen
(74) *Attorney, Agent, or Firm*—McGuinness & Manaras LLP

(57) ABSTRACT

A tool temporarily supports a first piece of siding against a structure. The tool is removable after the first piece of siding is at least partially secured to the structure. The tool is then usable to temporarily support a second piece of siding against the structure by temporarily securing the tool to the first piece of siding. The tool includes a longitudinal member with a hook at one end. The hook is used for temporarily securing the tool to the first piece of siding by placing the hook over the top edge of the first piece of siding. The tool includes another longitudinal member for temporarily supporting the second piece of siding. A handle section on the tool facilitates positioning, insertion, and removal of the tool. The tool is also adjustable to control the exposure of a previously installed piece of siding relative the temporarily supported piece of siding.

7 Claims, 5 Drawing Sheets

SIDING INSTALLATION TOOL

CROSS REFERENCE TO RELATED APPLICATIONS

The present application claims priority to provisional application Ser. No. 60/416,150 filed Oct. 4, 2002.

FIELD OF THE INVENTION

The present invention relates generally to construction tools, and more particularly to tools for aiding the installation of siding on building exteriors.

BACKGROUND OF THE INVENTION

Siding is attached to the exterior of buildings as a protective layer against the environment. Clapboard sidings including those made from composites such as wood fibers, wood chips and fiber cement are some of the most widely used sidings in North America. Most shingle sidings, vinyl sidings and even some clapboard sidings are sufficiently light in weight that installation may be accomplished by one person. However, the typical clapboard siding workpiece is relatively heavy and long. For example, a fiber cement clapboard siding workpiece may weigh 20 pounds and measure 12 feet or more in length. Aligning and securing such a workpiece during installation typically requires more than one person. What is needed is a way of automatically installing siding, preferably in such a way that the installation can be accomplished by a single user.

SUMMARY OF THE INVENTION

The invention includes a method and tool for facilitating installation of siding. The invention may be employed to increase installation efficiency and reduce the number of people required to install the siding. In most cases the invention will enable installation of siding by a single person.

In accordance with the invention, a tool is provided for temporarily supporting a first piece of siding against a structure. The tool is removable after the first piece of siding is at least partially secured to the structure. The tool is further usable for temporarily supporting a second piece of siding against the structure by temporarily securing the tool to the first piece of siding. More particularly, the tool includes a first longitudinal member with a hook at one end. The hook is used for temporarily securing the tool to the first piece of siding by placing the hook over the top edge of the first piece of siding. The tool further a second longitudinal member for temporarily supporting the second piece of siding. A handle section on the tool facilitates positioning, insertion, and removal of the tool. The tool is also adjustable to control the exposure of a previously installed piece of siding relative to the piece of siding being temporarily supported.

Two of the tools may be used to temporarily support a piece of clapboard while it is secured to a building by a single person. The tools may then be removed and used to install another piece of clapboard.

BRIEF DESCRIPTION OF THE DRAWINGS

In order to facilitate a fuller understanding of the present invention, reference is now made to the appended drawings.

These drawings should not be construed as limiting the present invention, but are intended to be exemplary only.

DETAILED DESCRIPTION OF EXEMPLARY EMBODIMENTS

In accordance with the invention, a tool is provided for temporarily supporting a first piece of siding against a structure. The tool is removable after the first piece of siding is at least partially secured to the structure. The tool is further usable for temporarily supporting a second piece of siding against the structure by temporarily securing the tool to the first piece of siding.

Figure 1:
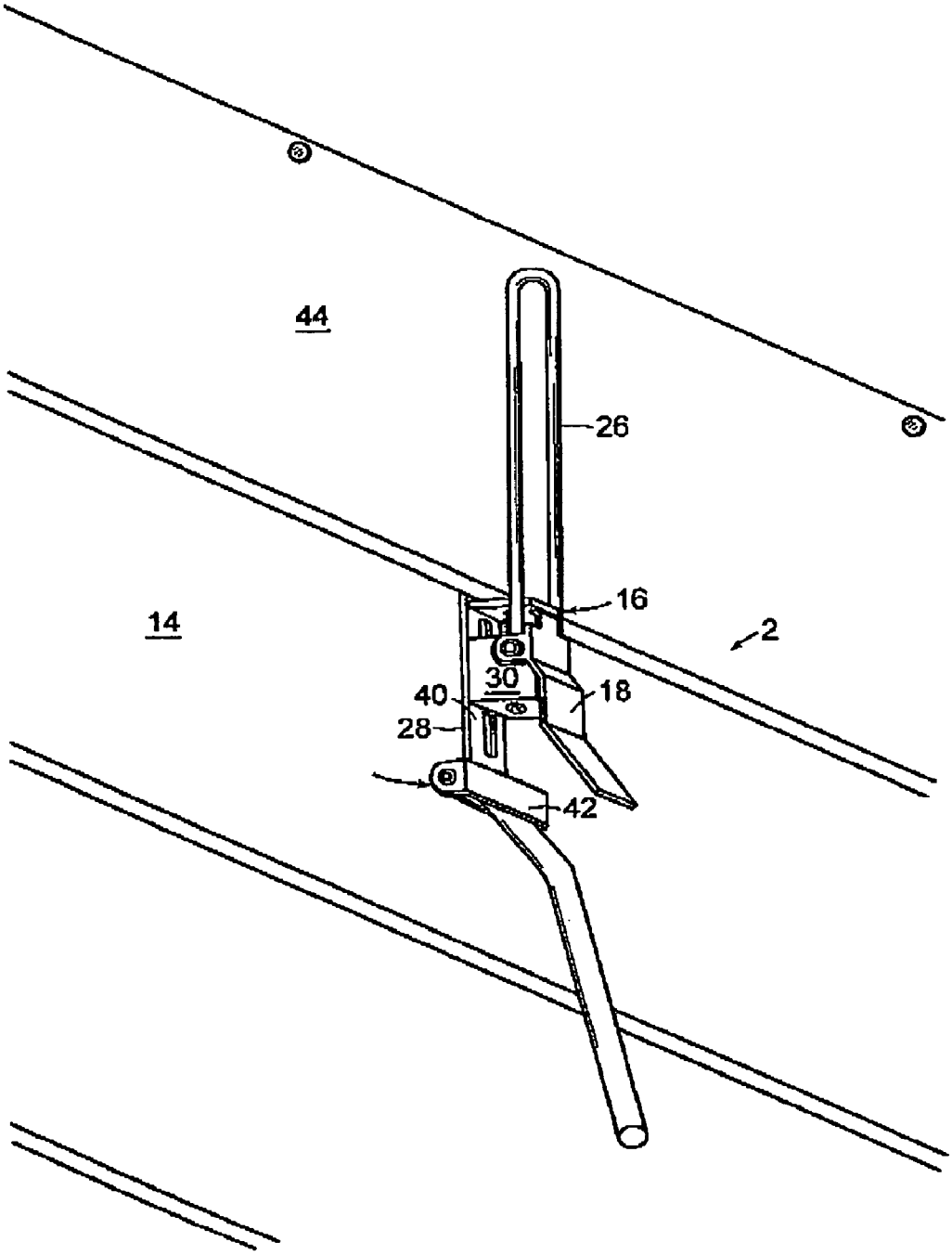
FIG. 1 is a perspective view of a siding installation tool in operation in accordance with the invention.
Figure 2:
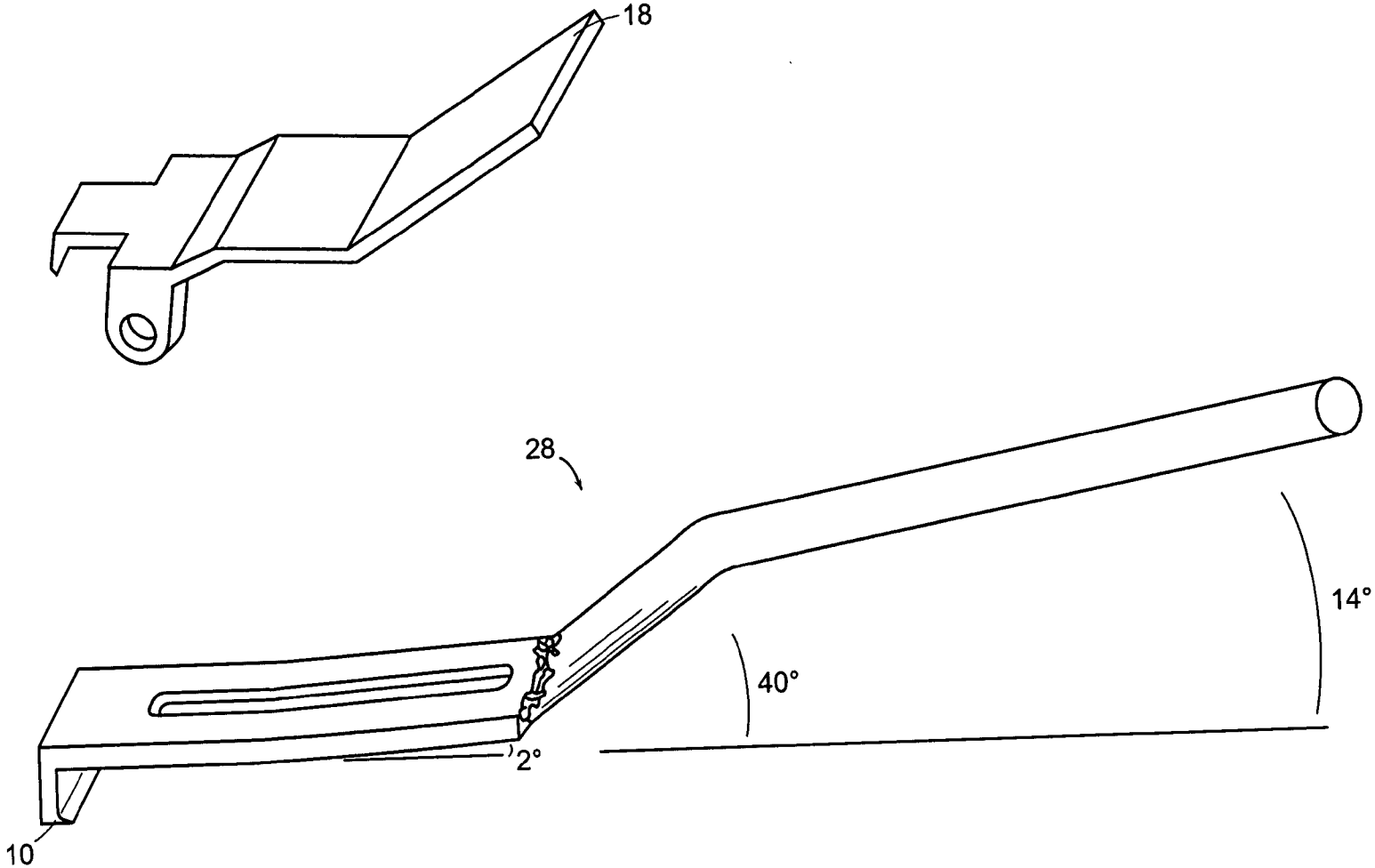
FIG. 2 is a perspective view of a longitudinal member that constitutes a portion of the siding installation tool.
Figure 3:
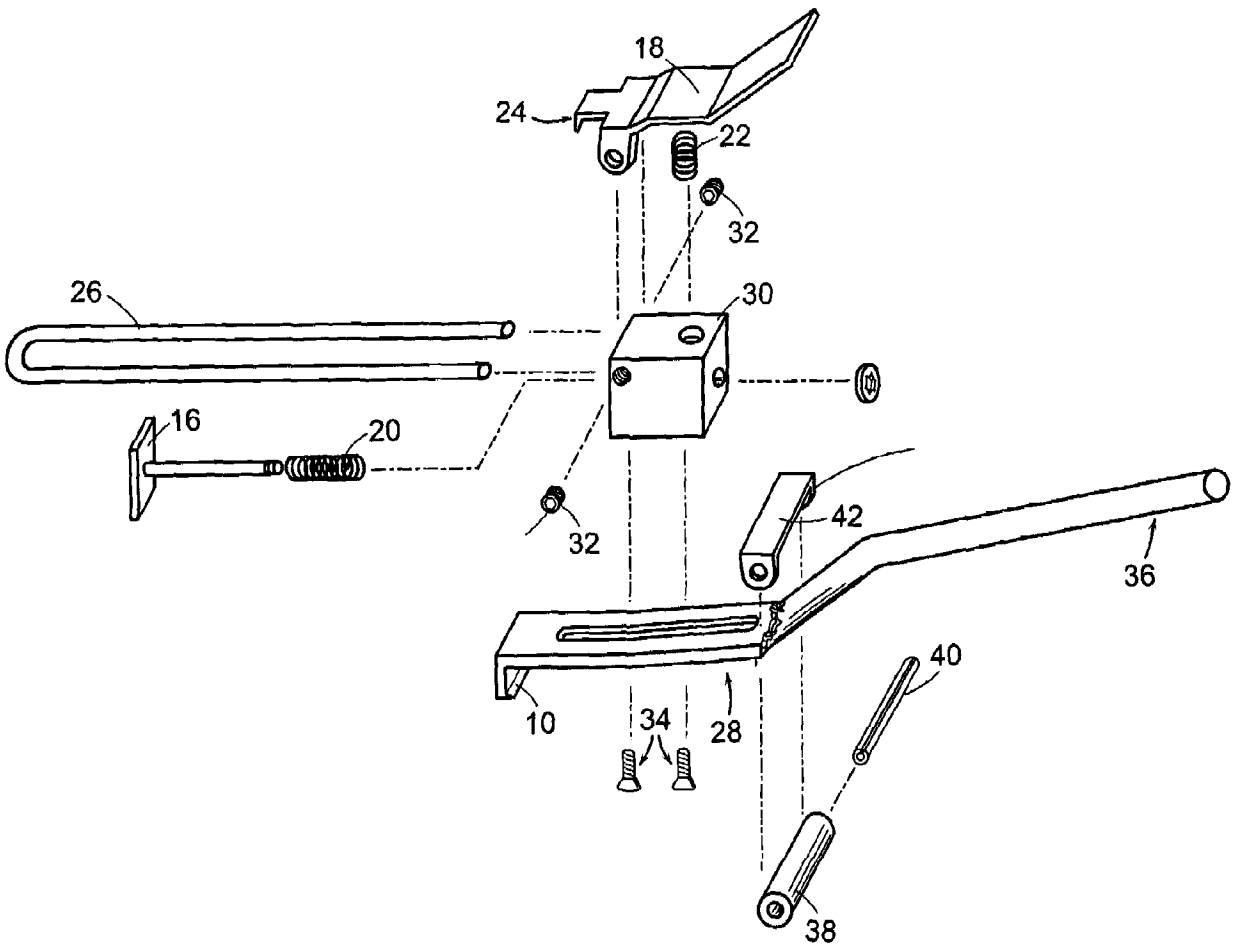
FIG. 3 is an exploded view of the siding installation tool of the invention.
Figure 4:
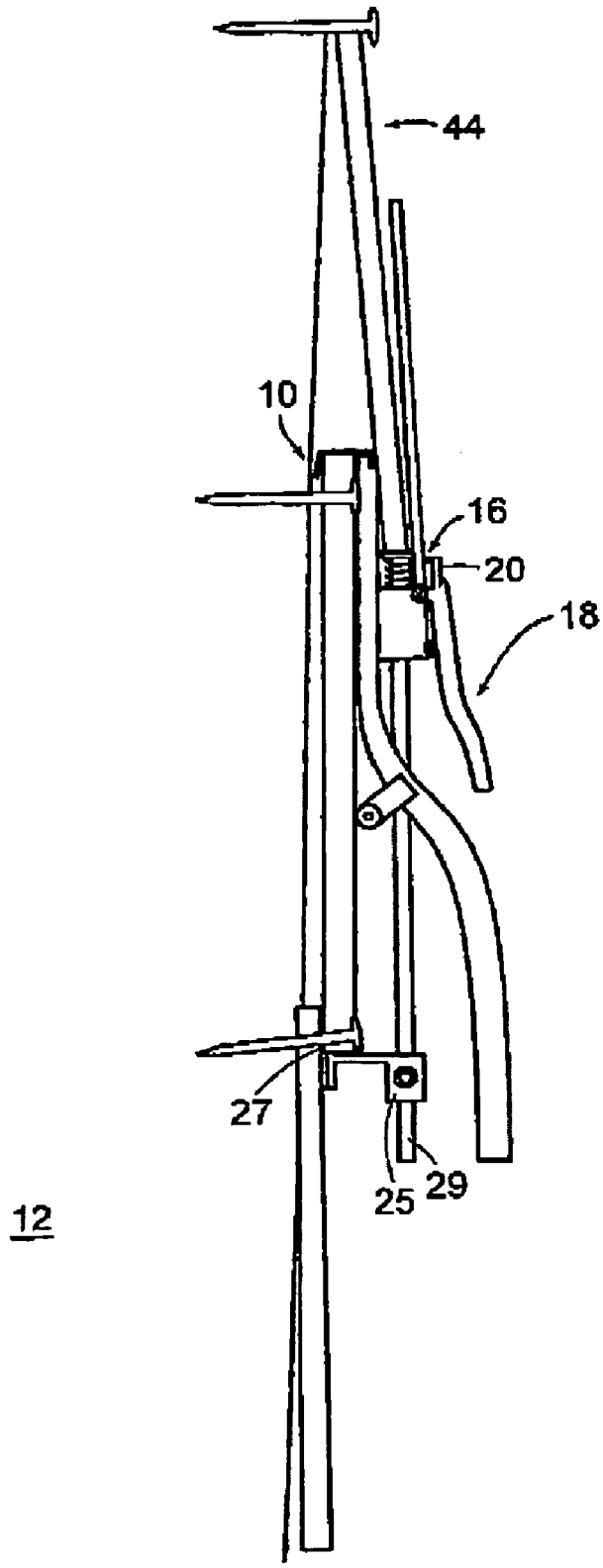
FIG. 4 is a side view of the siding installation tool in operation.

Referring to FIG. 1, an illustrative embodiment of the invention is shown in use in its intended environment. The siding tool 2 is installed against a building 12. The siding tool 2 rests upon an installed clapboard 14 in order to aid the installation of another length of clapboard 44. In FIGS. 2 and 3, a longitudinal member 28 of the siding tool 2 is shown. A hook 10 is provided at the securing end of the member 28 for temporarily securing the tool 2 to the building 12. In particular, as shown in FIG. 4, the longitudinal member 28 includes a hook 10 that secures to the building 12 by slipping behind the top side of a previously secured piece of clapboard 14. A stopper seat 16, also seen in FIG. 4, is positioned proximate to a release lever 18 at a predetermined distance from the hook 10 in order to facilitate achieving the overlap requirements of the siding application. A spring 20 (FIGS. 3, 4) is employed to push the seat 16 up. Another spring 22 (FIG. 3) is employed to enable the top 24 of the release lever 18 to provide support for the seat 16.

Figure 5:
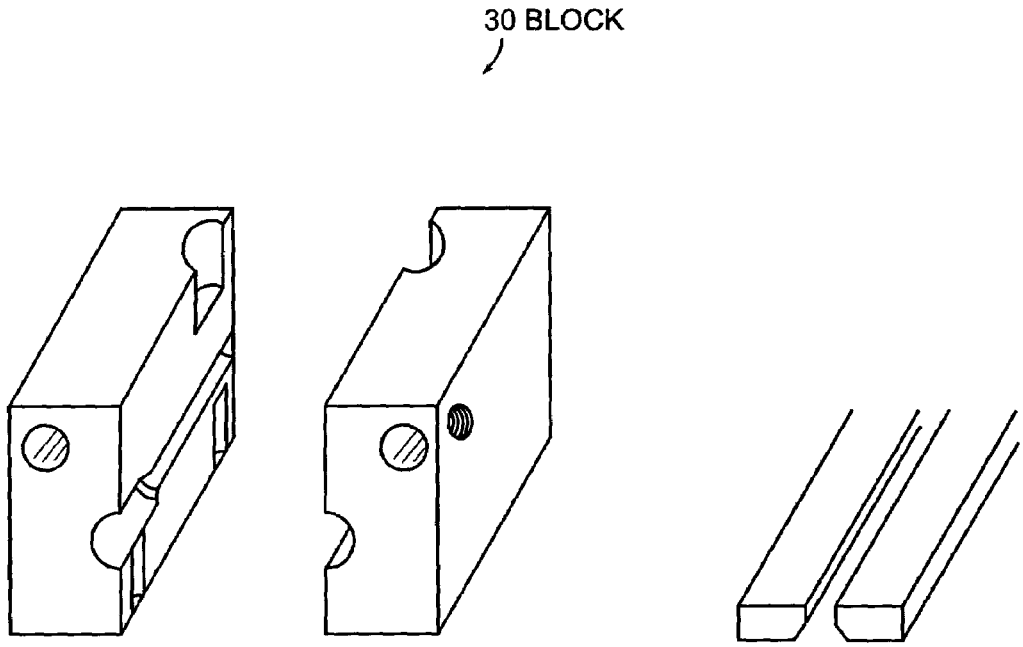
FIG. 5 is an exploded view of a block that constitutes a portion of the siding installation tool.

As seen in for example in FIG. 1, the means for temporarily supporting a piece of clapboard includes two parallel longitudinal members 26, 28. The first longitudinal member 28 includes the hook 10 for securing the tool 2 to a previously installed piece of clapboard as previously described. The second longitudinal member 26 is herein embodied as a U-shaped metal rod, though clearly other shapes could be employed, such as a square shaped rod, or a pair of rods. The ends of the rod are secured in holes in a block 30 with set screws 32 (FIGS. 1, 3, 5). The block 30 is also secured to the first longitudinal member 28 with machine screws 34 (FIG. 3). The first longitudinal member 28 and the corresponding side of block 30 include alignment grooves 40 which facilitate layout adjustment and prevention of slippage. The first member 28 also includes a handle section 36 (FIG. 3) which facilitates positioning, insertion and removal of the tool 2. Further, a roller 38 and tension pin 40 are secured to the second member 28 with section 42 (FIGS. 1, 3).

An adjustable tab 25 (FIG. 4) may be used to verify the exposure measured from the seat 16 of the installed course 14 to the bottom 27 of the previous course of siding. The tab 25 may be mounted on a flexible rod 29. Loosening a set screw or similar feature allows the tab to slide along the rod 29. The rod may have visual reference marks to indicate the measurement of the exposure. This feature is desirable because small variations exist in the actual widths of siding within manufacturing tolerances.

In practice the invention may be employed by hanging one or more tools 2 from the previous course of siding 14 and setting the next course into position on the tools 2. In particular, two of the tools 2 are employed to support and align the siding 44. Alternatively, more than two or even a single tool 2 may be used to support the siding 44 during installation. Once the siding 44 is supported in place, the installation professional fastens the course of siding 44 with the predetermined overlap. Once the siding 44 is secured to the building 12, the tool 2 is removed. It should be noted that it may be desirable to remove the tool 2 before all of the fasteners have been installed in the siding because there is generally more space available to ease removal of the tool 2 before fasteners are installed in close proximity to the tool 2. For example, the professional may install only enough fasteners to support the piece of siding before removing the tools 2. Tool removal is accomplished by depressing the release lever 18, pushing the tool upwards to unhook from the previous course 14, pushing inward on the handle section to pry the hook 10 away from the building, and pulling the tool down from between the two courses of siding 44 and 14. In this manner, siding may be installed more efficiently and in most cases by a single installation professional.

The tab 25 may be used to facilitate installation of the first course of siding. For the first course of siding, two tools 2 are secured to the building in a predetermined position. In particular, a fastener such as a nail is used to hang each tool 2 by the top portion of the first longitudinal member 26. Measurements will be made before installing the nail. Once the tools are hung on the respective nails, siding is hung on the tab 25 portion of the tool. In particular, the tab 25 includes a hook section that is positioned to accept the siding when the tab 25 is slid off of the rod 29 and inverted relative to its normal position. The inverted tab is then secured at a predetermined position on the rod 29 before the siding is placed on the hook portion of the tab.

The present invention is not to be limited in scope by the specific embodiments described herein. Indeed, various modifications of the present invention, in addition to those described herein, will be apparent to those of ordinary skill in the art from the foregoing description and accompanying drawings. Further, although the present invention has been described herein in the context of a particular implementation in a particular environment for a particular purpose, those of ordinary skill in the art will recognize that its usefulness is not limited thereto and that the present invention can be beneficially implemented in any number of environments for any number of purposes. For example, though the invention has been described in terms of facilitating the installation of siding on the exteriors of buildings, the invention can be likewise employed to facilitate the installation of various sorts of wall coverings on building interior walls. The construction of the siding installation tool has been described in terms of a certain embodiment including certain mechanical structures, yet the skilled artisan will realize that the functionality of the described siding installation tool may in fact be embodied in several different ways without departing from the spirit and scope of the invention. All such modifications are intended to fall within the scope of the following appended claims. Accordingly, the claims set forth below should be construed in view of the full breadth and spirit of the present invention as disclosed herein.

I claim:

1. Apparatus for facilitating installation of siding comprising:

a tool having:

a first longitudinal member; and a support member coupled with the first longitudinal member, the support member being movable relative to the first longitudinal member in a first mode and securably positioned relative to the first longitudinal member in a second mode for temporarily supporting a first piece of siding via the support member in the second mode against a structure by suspending the tool from the second piece of siding with the longitudinal member, said tool being removable after said first piece of siding is at least partially secured to said structure by moving the support member relative to the first longitudinal member in the first mode wherein the support member includes a seat, a base, and a seat support coupled with the base such that operating the seat support reconfigures the tool from the second mode to the first mode.

2. The tool of claim 1 wherein the first longitudinal member includes a hook at one end, the hook being operable for temporarily securing the tool to the first piece of siding by placing the hook over the top edge of the first piece of siding.

3. The tool of claim 2 wherein the seat support includes a lever and a second longitudinal member for temporarily supporting the second piece of siding.

4. The tool of claim 3 wherein the first longitudinal member comprises a handle section with a roller to facilitate positioning, insertion, and removal of the tool without marring the siding.

5. The tool of claim 4 wherein the base is both slidably movable and securable with respect to the first longitudinal member, whereby the tool is adjustable to control the exposure of a previously installed piece of siding relative to the piece of siding being temporarily supported.

6. A tool for facilitating the installation of siding comprising:

a first longitudinal member with a hook at one end, the hook for temporarily securing the tool to a first installed piece of siding by placing the hook over the top edge of the first piece of siding;

a second longitudinal member coupled to the first longitudinal member for temporarily supporting a second piece of siding;

a handle section coupled to the first and second longitudinal members to facilitate positioning, insertion, and removal of the tool;

an adjustable base for controlling the longitudinal position of the first longitudinal member relative to the second longitudinal member to control the exposure of the first installed piece of siding relative to the second piece of siding being temporarily supported; and a seat operable to support an edge of the second piece of siding in a first position, and movable independent of the first longitudinal member so that the seat does not support the second piece of siding in a second position.

7. A method of installing siding on a structure comprising the steps of:

temporarily securing a tool to a first installed piece of siding by placing the hook residing at one end of a first longitudinal member of the tool over the top edge of the first piece of siding;

temporarily supporting a second piece of siding by placing the second piece of siding between the structure and a second longitudinal member on the tool coupled to the first longitudinal member;

using an adjustable seat on the tool for controlling the longitudinal position of the first longitudinal member relative to the second longitudinal member to control the exposure of the first installed piece of siding relative to the second piece of siding being temporarily supported;

at least partially securing the second piece of siding to the structure;

using a handle section of the tool coupled to the first and second longitudinal members to remove the tool.

* * * * *